US008156590B2

(12) United States Patent
Park et al.

(10) Patent No.: US 8,156,590 B2
(45) **Date of Patent: *Apr. 17, 2012**

(54) CONTROLLING METHOD OF A LAUNDRY MACHINE

(75) Inventors: Seog Kyu Park, Changwon-si (KR); Youn Dong Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 905 days.

This patent is subject to a terminal disclaimer.

(21) Appl. No.: 12/155,269

(22) Filed: May 30, 2008

(65) Prior Publication Data

US 2009/0013729 A1 Jan. 15, 2009

Related U.S. Application Data

(63) Continuation-in-part of application No. 11/629,321, filed on Jan. 26, 2009.

(30) Foreign Application Priority Data

Mar. 25, 2005 (KR) ..... 10-2005-0025055
Aug. 16, 2007 (KR) ..... 10-2007-0082260

(51) Int. Cl.
*D06F 39/04* (2006.01)

(52) U.S. Cl. ..... 8/149.1; 8/149.3; 68/15

(58) Field of Classification Search ..... 8/149.1–149.3, 8/158, 159; 68/15

See application file for complete search history.

(56) References Cited

U.S. PATENT DOCUMENTS

| | | | | |
|---|---|---|---|---|
| 7,325,330 | B2 * | 2/2008 | Kim et al. | 34/407 |
| 2004/0237603 | A1 * | 12/2004 | Kim et al. | 68/15 |
| 2004/0255391 | A1 * | 12/2004 | Kim et al. | 8/149.3 |
| 2006/0016020 | A1 | 1/2006 | Park | |

FOREIGN PATENT DOCUMENTS

| | | | |
|---|---|---|---|
| CN | 1537995 | A | 10/2004 |
| DE | 19743508 | A1 | 4/1999 |
| EP | 1 555 338 | | 7/2005 |
| KR | 10-2002-0067352 | | 8/2002 |
| KR | 10-2006-0101951 | | 9/2006 |
| KR | 10-2007-0021649 | A | 2/2007 |
| KR | 10-2007-0059429 | | 6/2007 |
| KR | 10-2008-0057725 | | 6/2008 |
| WO | WO 2006/101362 | | 9/2006 |

* cited by examiner

*Primary Examiner* — Joseph L Perrin

(74) *Attorney, Agent, or Firm* — McKenna Long & Aldridge LLP

(57) ABSTRACT

A controlling method of a laundry machine is disclosed. The controlling method includes supplying wash water into a tub up to a predetermined water level, and controlling On/Off of a steam heater and a tub heater until a temperature inside the tub or a drum reaches a predetermined temperature at the predetermined water level. By using both the tub heater and steam heater in conjunction with a controlling of a water supply valve in order to acquire the predetermined water level and predetermined tub temperature, the controlling method is advantageous to improve energy efficiency of the laundry machine.

19 Claims, 4 Drawing Sheets

CONTROLLING METHOD OF A LAUNDRY MACHINE

This application claims the benefit of the Korean Patent Application No. 10-2007-0082260, filed on Aug. 16, 2007 and Korean Patent Application No. 10-2005-0025055, filed on Mar. 25, 2005, which are hereby incorporated in its entirety. Also, this application is a continuation in part of U.S. patent application Ser. No. 11/629,321 filed on Jan. 26, 2009.

BACKGROUND OF THE INVENTION

1. Field of the Invention

The present invention relates to a laundry machine to wash laundry, and more particularly, to a laundry machine having a steam generator to supply steam to laundry.

2. Discussion of the Related Art

Generally, laundry machines include, for example, a drum laundry machine, in which washing of laundry is implemented with a relatively small amount of water as the laundry received in a drum is lifted by lifters and falls due to gravity, and a pulsator or standing type laundry machine, in which a large amount of wash water is supplied into an upright drum such that washing of laundry is implemented by frictional water flow during rotation of the laundry.

Of conventional drum laundry machines, some include a heater mounted in a tub. In this case, wash water can be heated using the heater and consequently, the laundry machines achieve improved washing using the heated wash water. However, these conventional laundry machines have a problem of excessive consumption of energy because they have to heat a large amount of water in the tub.

Recently, laundry machines having a steam generator have been entered the market. This type of laundry machine supplies steam to the tub, and thus, achieves improvement not only in washing result but also in energy efficiency.

In view of energy consumption, there is a limit to raise a temperature of laundry or an environment temperature in the tub up to a desired level by heating wash water in the tub. Heating all of the wash water to be consumed during the wash to a desired water temperature is inefficient in view of energy.

The temperature of laundry or the environment temperature in the tub is one important factor affecting a washing result. Therefore, it is desirable to select a most effective one of various methods of raising the temperature of laundry or the environment temperature in the tub to a desired level.

As can be seen from this point of view, it will be understood that supplying steam is a more energy efficient method than heating all of the wash water. Converting a small amount of water into steam and supplying the steam to the tub rather than heating all of the wash water considerably reduces energy consumption.

Steam has a high temperature and thus, is advantageous to further raise a temperature of or around laundry, etc. Consequently, the steam can provide a laundry machine with improved washing.

As described above, the use of the steam generator yields substantial improvements in washing result and energy consumption. However, there is always a need for progressive laundry machines. That is, there is always a need for laundry machines with better washing performance or further reduced energy consumption.

SUMMARY OF THE INVENTION

The present invention is related to a controlling method of a laundry machine that substantially obviates one or more problems due to limitations and disadvantages of the related art.

An object of the present invention is to provide a laundry machine having improved energy efficiency and improved washing performance.

Most conventional laundry machines having a steam generator have been designed to raise a temperature of laundry or an environment temperature in a tub depending on almost entirely steam. However, it has been found that using steam alone often yields unsatisfactory temperature-raising effects. For example, when a steam generator has an insufficient capacity, there is a limit to raise the temperature to a target temperature.

Further, even if the target temperature is accomplished using steam, there is a risk of immediately losing the effects of steam in the case where wash water having a relatively low temperature is used in following washing steps. Accordingly, using only steam can be ineffective in the views of both washing performance and energy consumption.

Additional advantages, objects, and features of the invention will be set forth in part in the description which follows and in part will become apparent to those having ordinary skill in the art upon examination of the following or can be learned from practice of the invention. The objectives and other advantages of the invention can be realized and attained by the structure particularly pointed out in the written description and claims hereof as well as the appended drawings.

An embodiment of the controlling method according to the present invention comprises: supplying water into a tub until a water level of the tub reaches a water level predetermined for a washing step; and controlling a steam heater and a tub heater until a temperature inside the tub reaches a temperature predetermined for the washing step at the predetermined water level.

The steam heater is a heater to heat water, so as to generate steam to be supplied to the tub. The tub heater is a heater to heat wash water in the tub.

Using the steam heater and the tub heater is one feature of the controlling method. As compared to the prior art using only the steam generator or only the tub heater, the above controlling method is more effective in view of energy consumption.

When a temperature inside the tub (hereinafter, referred to as a "tub temperature") reaches a predetermined temperature, the water in the tub is at a predetermined water level.

The predetermined temperature and the predetermined water level can be determined for a single washing step. Also, a variety of wash cycles including, for example, a heavy duty cycle, normal/casual cycle, and a delicate cycle can be provided. Here, each of the wash cycles generally includes a washing step, a rinsing step, a spin-drying step, etc.

The predetermined water level can be more than a minimum water level at which the tub heater in the tub can be completely immersed in the wash water.

The supplying of water into the tub until the water level of the tub reaches the predetermined water level is implemented at least until controlling of the heaters is completed. Accordingly, when the controlling of the heaters is completed, the wash water in the tub is at the predetermined water level, and the tub temperature is at the predetermined temperature.

Here, the tub temperature can be an environment temperature in the drum or the tub, or can be a temperature of wash water in the tub. When it is difficult to sense the environment temperature in the drum, a temperature sensor can be used to sense the environment temperature in the tub. Also, when it is difficult to sense the environment temperature, the temperature sensor can be used to sense a temperature of wash water in the tub.

After completing the controlling of the heaters, the washing step can be continued for a predetermined time under conditions of the predetermined water level and the predetermined temperature. In this case, if the steam heater or the tub heater is not turned on again, the tub temperature will gradually decrease. Also, the wash water in the tub will be at the predetermined water level so long as wash water is not additionally supplied into the tub.

It can be desirable to supply no additional wash water after completing the controlling of the heaters. This is because the additionally supplied wash water can rapidly decrease the tub temperature. However, the additional supplying of wash water must not be excluded. When wash water is additionally supplied, it can be expected that the steam heater or the tub heater can be reactivated.

There can be proposed various methods for allowing the water level in the tub and the tub temperature to reach the predetermined water level and the predetermined temperature, respectively. For example, the predetermined water level and the predetermined temperature can be accomplished by only supplying steam, or by only heating the wash water in the tub. However, more effective method, in view of energy consumption, appropriately uses both the steam heater and the tub heater. In this case, it is important to match the supplying of wash water into the tub with the controlling of both the heaters.

As a first method of the present invention, the supplying of water is completed prior to beginning the controlling of the heaters. That is, after water is supplied until the water level in the tub reaches the predetermined water level, the tub temperature is raised to the predetermined temperature using the steam heater and the tub heater.

In this case, the steam heater and the tub heater can be alternately turned on, rather than being turned on simultaneously. This is because turning on the two heaters simultaneously can cause a shortage of electric power.

In the above-described controlling method, steam is supplied for a predetermined time by operation of the steam heater, and thereafter, the tub heater is turned on and kept on until the tub temperature reaches the predetermined temperature. Here, the On/Off controlling of the steam heater can be implemented depending on the tub temperature. For example, the controlling method can be implemented to supply steam to the laundry until the tub temperature reaches a predetermined temperature (lower than the above-mentioned predetermined temperature), rather than keeping the steam heater on for the predetermined time.

Alternatively, prior to using the steam heater, the tub heater can be used for a predetermined time (or until the tub temperature reaches a predetermined temperature), so as to heat the wash water in the tub. In this case, after first heating the wash water in the tub using the tub heater, steam is supplied to the tub by operation of the steam heater, and then, the tub heater is again operated.

Due to space restrictions within the laundry machine, it can be considered to use a steam generator having a small capacity. Using the small-capacity steam generator can limit an ability to raise the tub temperature to a desired level using steam alone. On the other hand, in consideration of a general tub size, the capacity of the tub heater designed to be mounted in the tub is less restricted. For this reason, it can be more effective to complete the controlling of the heaters by using the tub lastly.

As a second method of the present invention, the supplying of water is implemented such that the water level in the tub rises gradually while the steam heater is kept on.

The gradual supplying of water is continued until the supplying of water is completed. That is, wash water is gradually supplied until the water level in the tub reaches the predetermined water level. In this case, an initial supplying of water can be added, prior to the above-described gradual supplying of water. More specifically, after wash water is initially supplied to a level sufficient to permeate the laundry, the gradual supplying of water is implemented while the steam heater is kept on.

In this case, an amount of wash water appropriate to permeate the laundry received in a drum can be supplied for the initial supplying of water. During the initial supplying of water, a circulation pump is operated to achieve uniform permeation of water throughout the laundry. If steam contacts to dry laundry, there is a risk, according to the kind of laundry, of damaging the laundry due to a high temperature of the steam. Such allowing water to uniformly permeate the laundry prior to supplying steam is also applicable to others (for example, the previously described first method or a third method that will be described hereinafter).

Simultaneously with completing the supplying of water, the steam heater is switched to "off", and the tub heater is turned on. The controlling of the heaters is completed as the tub heater is switched to "off".

During the initial supplying of water, a water supply valve can be controlled such that it is opened and kept opened until the wash water in the tub reaches or exceeds the predetermined water level. For example, the water supply valve can be controlled during the initial supplying of water such that it is kept opened after opened, and then, is closed when the water level in the tub reaches or exceeds the predetermined water level. In other words, with one opening of the water supply valve, water reaches the predetermined level or higher. If the circulation pump is operated after the initial supplying of water, the wash water in the tub permeates the laundry in the drum, and thus the level of water in the tub goes down.

In the case where a sufficient amount of wash water is supplied during the initial supplying of water, the wash water in the tub can be heated using the tub heater, prior to using the steam heater. In this case, if the water level in the tub decreases to a water level insufficient to keep the tub heater on, the tub heater is switched to "off". However, if a sufficient water level in the tub is secured, the tub heater can be continuously used before the steam heater is used.

Meanwhile, to implement the gradual supplying of water, the water supply valve can be continuously kept in an opened state. However, according to characteristics of the water supply valve, this may cause the wash water to be supplied at an excessively high flow rate. Therefore, the controlling of specific water supply valves can be performed in such a way that the water supply valve is intermittently opened and closed.

As a third method of the present invention, the supplying of water can comprise: initially supplying the water; and finally supplying the water up to the predetermined water level when or in between turning off the steam heater and turning on the tub heater.

In this way, water is supplied to the predetermined water level around a time when changing from a steam-heater-on mode to a tub-heater-on mode.

In this case, an intermediate supplying of water can be included between the initial supplying of water and the final supplying of water. The intermediate supplying of water is a step of maintaining wash water supplied into the tub for the initial supplying of water within a predetermined range of level. As the wash water supplied during the initial supplying of water permeates the laundry, the water level in the tub decreases. In this case, to maintain the water level in the tub within a predetermined range, the intermediate supplying of water is performed.

The water supply valve is kept opened once opened for the initial supplying of water, and then, is closed when the water level in the tub reaches a first water level. The water supply valve is controlled such that it is again opened if the water level in the tub reaches a lower limit of the predetermined range as the wash water permeates the laundry in the drum, and then, is closed if the water level in the tub reaches an upper limit of the predetermined range. In this way, after completing the initial supplying of water, the water level in the tub can be maintained within the predetermined range. Here, the upper limit of the water level within the predetermined range can be equal to the water level predetermined for the washing step.

If the steam heater is switched to "off" while the water level in the tub is maintained within the predetermined range, the final supplying of water is implemented, prior to turning on the tub heater.

While the tub heater is kept on, the circulation pump can be controlled to be kept off. Since a part of wash water in the tub is introduced into a circulation passage during circulation thereof, the water level in the tub decreases. Such a decrease in the water level causes the tub heater to be exposed above the surface of the water, and consequently, causes overheating of the tub heater.

With the above-described present invention, to acquire the predetermined water level in the tub and the predetermined tub temperature, both the tub heater and the steam heater can be used together, in conjunction with a controlling of the water supply valve. Accordingly, the present invention can achieve improved energy efficiency.

In particular, using the tub heater together with the steam heater (in consideration of a situation where an small-capacity steam generator is used), the present invention can acquire a desired water level in the tub and a desired tub temperature, which could be hard to obtain when using steam alone.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
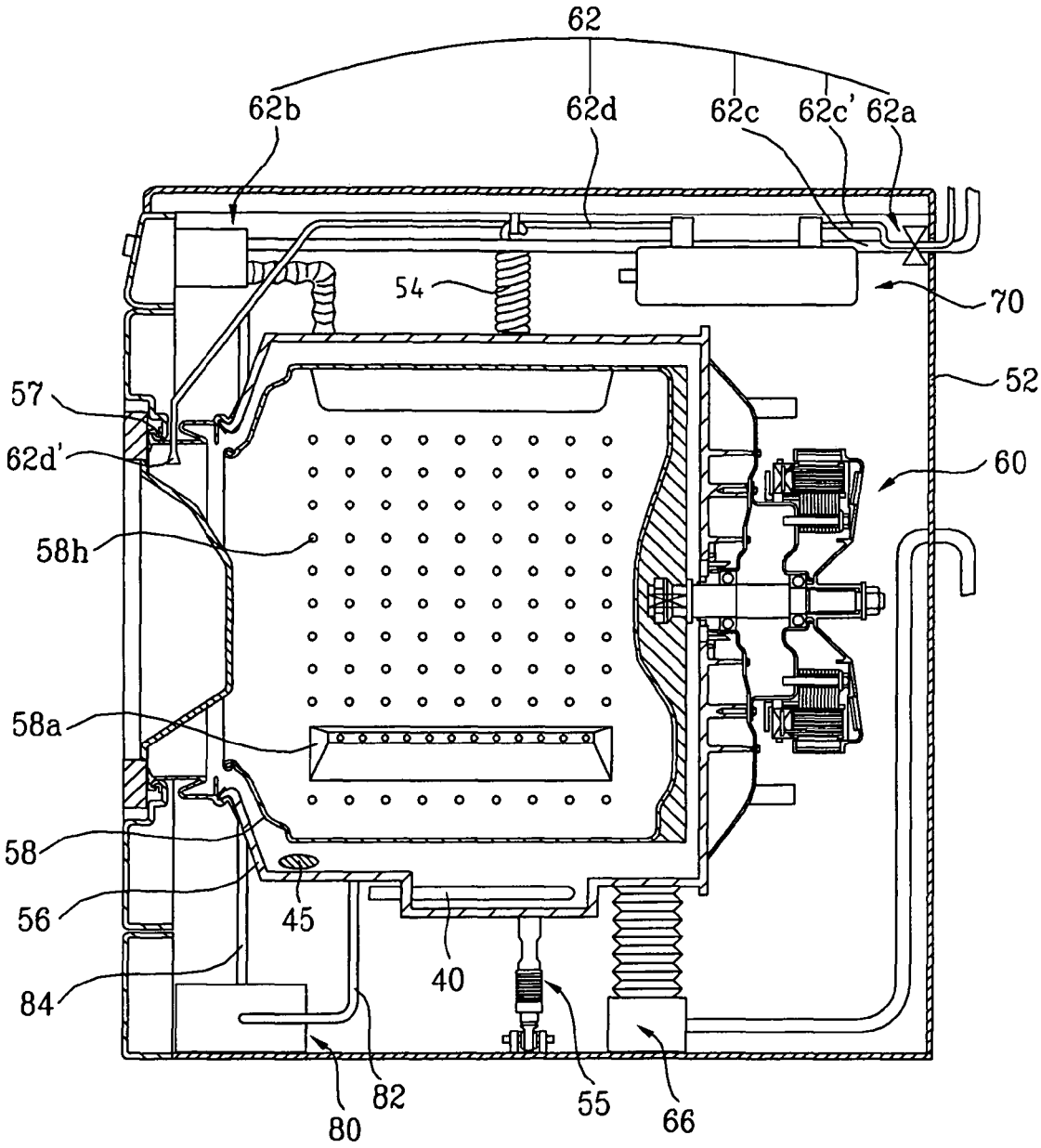
FIG. 1 is a view illustrating a drum laundry machine.

FIG. 1 illustrates a drum laundry machine, which includes a steam generator and a tub heater to heat wash water received in a tub.

The drum laundry machine includes a cabinet 52 defining the exterior appearance of the drum laundry machine, a tub 56 supported in the cabinet 52 by means of a spring 54 and a damper assembly 55, a drum 58 located in the tub 56, a motor 60 located at a rear side of the tub 56 and used to rotate the drum 58, a steam generator 70 to generate steam by heating water, and a circulation pump 80 to pump wash water in the tub 56 upward for circulation of the wash water. The drum 58 has a plurality of holes **58*h* perforated in a circumferential wall thereof, and is provided, at an inner wall surface thereof, with lifters 58*a***.

The above-described drum laundry machine further includes a water supply device 62 to supply wash water into the tub 56, and a water drain pump assembly 66 to drain the wash water.

More specifically, the water supply device 62 includes a water supply valve assembly **62*a*, a first water supply passage 62*c*, and a detergent box assembly 62*b* in which detergent is stored. The steam generator 70 is connected to the water supply valve assembly 62*a* through a second water supply passage 62*c***.

A tub heater 40 to heat wash water is installed in the tub 56. Also, a temperature sensor 45 is installed in the tub 56. The temperature sensor 45 can be installed at a different position from that shown in the drawing.

A steam passage **62*d* has a nozzle-shaped distal end 62*d'* to eject steam to laundry in the drum 58. The nozzle-shaped distal end 62*d'* passes through a gasket 57 connected between the tub 56 and the cabinet 52**.

All the respective configurations of the above-described drum laundry machine are known in the prior art. Therefore, a further description of some configurations not required to understand the present invention will be omitted herein.

Figure 2:
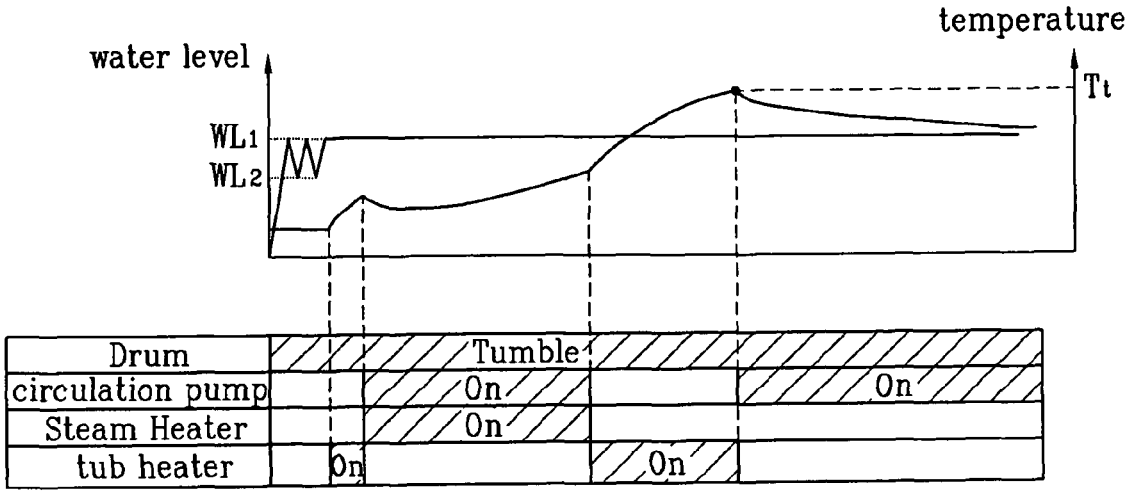
FIG. 2 is a view illustrating a first embodiment of the present invention.

Now, a first embodiment of a controlling method according to the present invention will be described with reference to FIG. 2.

Wash water is supplied into the tub through the water supply valve. In this case, the supplying of water is implemented until the water level in the tub reaches a first water level $WL_1$. More specifically, the water supply valve is closed when the water level in the tub reaches the first water level $WL_1$. Then, when the water level decreases to a second water level $WL_2$, the water supply valve is opened again to implement the supplying of water until the water level again reaches the first water level $WL_1$. The supplying of water is ended if the water level in the tub is kept at the first water level $WL_1$ via the above-described controlling of the opening/closing of the water supply valve.

Here, the first water level $WL_1$ is a higher level than a lower end of the drum, and is determined such that at least a portion of laundry in the drum can be immersed in the wash water.

After the water supply valve is initially opened to supply wash water to the first water level $WL_1$, a part of the wash water permeates the laundry, causing the water level in the tub to decrease. Thereby, when the water decreases to the second water level $WL_2$, the water supply valve is again opened to implement the supplying of water. If the drum is rotated during the supplying of water, the wash water can more rapidly permeate the laundry.

An ending time point of the supplying of water is a time point when the supplying of water up to the first water level $WL_1$ is finally implemented in a state wherein the laundry is sufficiently wet so as to no longer absorb water.

After completing the supplying of water, first, the tub heater is turned on to heat the wash water in the tub. In this case, the tub heater can be kept on for a predetermined time, or until the tub temperature reaches a first predetermined temperature.

Then, the tub heater is turned off, and the steam heater is turned on to eject steam into the drum. If a predetermined time passes after the steam heater is turned on, steam begins to be generated in the steam generator and is supplied into the drum.

Here, the steam heater can be appropriately controlled to supply steam into the drum from a time point when the tub heater is turned off. That is, the steam heater can be turned on before the tub heater is turned off as early as a time in between turning on the steam heater and generating the steam in the steam generator. As a result, the steam heater is turned on before the tub heater is turned off, and steam can be supplied into the drum substantially simultaneously with the tub heater being turned off. In this case, it is important to apply sufficient electric power to simultaneously keep both the steam heater and tub heater on. The above-described controlling of the tub heater and steam heater is applicable to other embodiments of the present invention.

The steam heater, likewise, can be controlled on the basis of time or temperature. Specifically, the steam heater can be kept on for a predetermined time, or until the tub temperature reaches a second predetermined temperature.

Then, the steam heater is turned off, and the tub heater is turned on to heat the wash water in the tub. The tub heater is kept on until the tub temperature reaches a third predetermined temperature.

At a time point when the tub temperature reaches the third predetermined temperature, the water in the tub is at the first water level $WL_1$. The drum is continuously rotated under the above-described conditions, to continue the washing of laundry for a predetermined time.

Meanwhile, the circulation pump is kept on to circulate the wash water in the tub except for the initial supplying of water and for a time while the tub heater is kept on. When the circulation pump is turned on to circulate the wash water during the initial supplying of water, the wash water can more rapidly permeate the laundry. However, since the circulation of wash water causes a change of the water level in the tub, it can have a disadvantageous effect on the controlling of the water supply valve based on the water level in the tub during the initial supplying of water. In the present embodiment, the first water level $WL_1$ is determined to allow a part of laundry to be immersed in the wash water. Therefore, the wash water can sufficiently permeate the laundry even by rotation of the drum without requiring circulation of the wash water.

It is advantageous, in view of safety, that a sufficient amount of water be received in a lower end region of the tub while the tub heater is kept on, to prevent the tub heater from being exposed above the surface of the water. Therefore, it is preferable to keep the circulation pump off while the tub heater is kept on.

The above-described first embodiment is based on the case where the supplying of water for setting the water level in the tub up to the first water level $WL_1$ is completed before a heater control operation of controlling the On/Off of the tub heater and steam heater. Specifically, in the first embodiment, the tub heater and steam heater are controlled such that the tub temperature reaches a predetermined temperature after completing the supplying of water for setting the water level in the tub to the predetermined water level.

Figure 3:
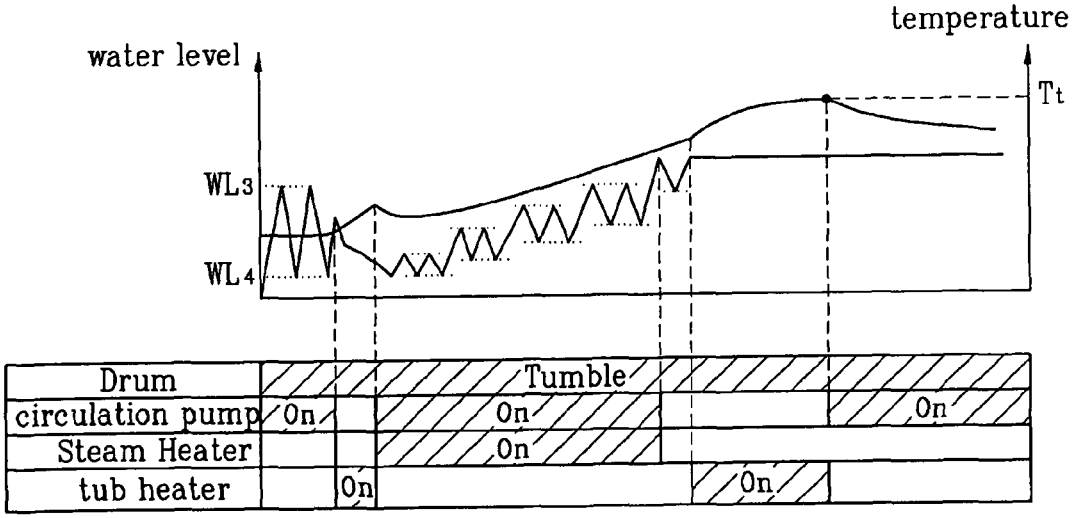
FIGS. 3 and 4 are views illustrating a second embodiment of the present invention.

FIG. 3 illustrates a second embodiment of the present invention.

The second embodiment is based on the case where water is gradually supplied while the steam heater is kept on.

First, the water supply valve is opened to supply water until the water level in the tub reaches a third water level $WL_3$. When the water level in the tub decreases to a fourth water level $WL_4$ as the supplied wash water permeates the laundry, the water supply valve is again opened to supply wash water until the water level in the tub reaches the third water level $WL_3$. In this case, since the circulation pump is kept on to circulate the wash water in the tub, there is no risk of a rapid decrease in the level of water in the tub. When the water level in the tub drops to the fourth water level $WL_4$, the supplying of water is again implemented. In this case, the supplying of water is continued only until the water level in the tub reaches a lower level than the third water level $WL_3$. Then, the circulation pump is turned off. Simultaneously with turning off the circulation pump, the water level in the tub decreases more gently.

The tub heater is turned on after the circulation pump is turned off. The tub heater is kept on for a predetermined time or until the tub temperature reaches a predetermined temperature. Alternatively, the tub heater can be turned off when the water level in the tub decreases to a predetermined water level. This is because overheating of the tub heater can occur when the tub heater is exposed above the surface of the water due to the low water level in the tub. For safety, the controlling of the tub heater in consideration of the water level in the tub can be used in conjunction with a controlling based on time or tub temperature.

After the tub heater is turned off, the steam heater is turned on to supply steam into the drum. The water supply valve is controlled while the steam heater is kept on, to gradually supply water into the tub.

To implement the gradual supplying of water, the water supply valve is controlled so as to be repeatedly turned on or off. With such a repetitive On/Off controlling of the water supply valve, the water level rises stepwise as shown in FIG. 3.

Here, if a predetermined time of keeping the steam heater on is previously set, the above-described gradual supplying of water is implemented to allow the water level in the tub to gradually reach the third water level $WL_3$ for the predetermined time. It is unnecessary to coincide the time of keeping the steam heater on with the implementation time of the gradual supplying of water, and they can be approximately matched with each other.

If the steam heater is turned off, the tub heater is turned on. Then, if the tub temperature reaches the predetermined temperature, the tub heater is turned off.

More specifically, the steam heater is turned off precisely when the water level in the tub reaches the third water level $WL_3$. When the water level in the tub is kept at the third water level $WL_3$, the tub heater is turned on and kept on. Here, a time point when the steam heater is turned off can accord or disaccord with a time point when the tub heater is turned on. If the water level in the tub is kept at the third water level $WL_3$ rather than further dropping, there is substantially no time in between turning off the steam heater and turning on the tub heater. Alternatively, the tub heater can be turned off at a time point when the steam heater is turned off, regardless of the water level, because the water level in the tub is in the vicinity of the third water level $WL_3$. This is likewise in other similar embodiments.

In the above-described second embodiment, likewise, the circulation pump is kept off while the tub heater is kept on. Also, the drum is rotated continuously.

After the tub heater is turned off as the tub temperature reaches the predetermined temperature, the drum is rotated for a predetermined time, to continuously implement washing of laundry.

Meanwhile, it is preferable to supply detergent together with the wash water during the initial supplying of water. This is likewise in other embodiments of the present invention.

The above-described second embodiment is based on the case where the water is gradually supplied while the steam heater is kept on after completing the initial supplying of water, and also, is based on the case where the supplying of water up to the predetermined third water level $WL_3$ is completed approximately at a time point when the steam heater is turned off. After completing the supplying of water up to the third water level $WL_3$, the tub heater is turned on.

Figure 4:
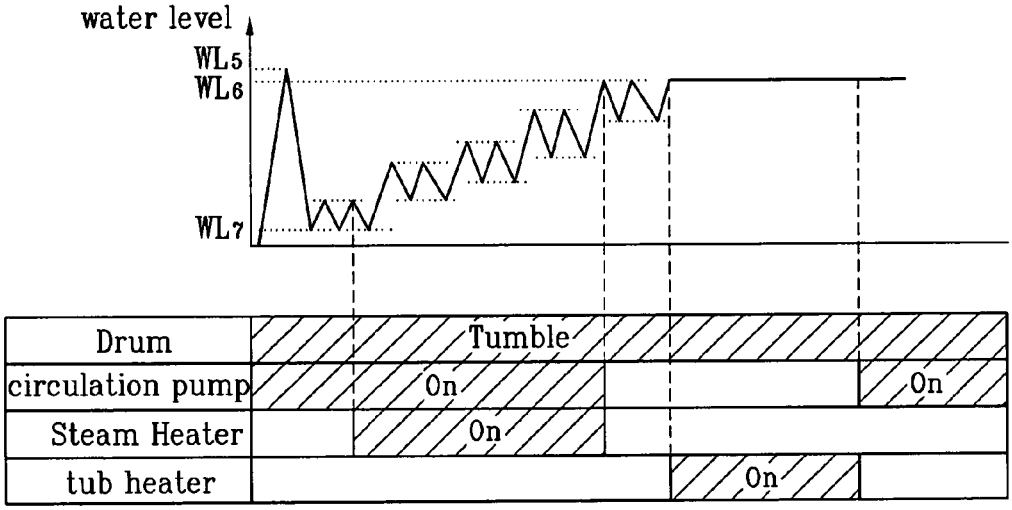

FIG. 4 illustrates another example of the second embodiment. In FIG. 4, the tub heater is not turned on after the initial supplying of water and before the steam heater is turned on. Differently from that of FIG. 3, the water level in the tub during the initial supplying of water is higher than a following predetermined water level (In FIG. 4, a fifth water level $WL_5$ is higher than a sixth water level $WL_6$).

The initial supplying of water in FIG. 4 is more rapidly implemented than that in FIG. 3.

During the initial supplying of water, the circulation pump is kept on, and the drum is rotated to allow the wash water to more rapidly permeate the laundry.

Thereafter, while the steam heater is turned on and kept on, the water supply valve is controlled so as to be repeatedly turned on or off, causing the water level in the tub to rise gradually. When the water level in the tub reaches the sixth water level $WL_6$, the tub heater is turned on and kept on. Likewise, when the tub temperature reaches the predetermined temperature, the tub heater is turned off.

In FIG. 4, the steam heater is turned off precisely when the water level in the tub reaches the sixth water level $WL_6$. The tub heater is turned on precisely when the water level in the tub is kept at the sixth water level $WL_6$ by an additional supplying of water. In this case, the circulation pump is paused for a time period after the steam heater is turned off and before the tub heater is turned on. This is because it is necessary to pause the circulation pump for the sake of accurate controlling of the water level. Likewise, if the water level in the tub is kept at the sixth water level $WL_6$ rather than further decreasing, there can be substantially no time in between turning off the steam heater and turning on the tub heater.

Figure 5:
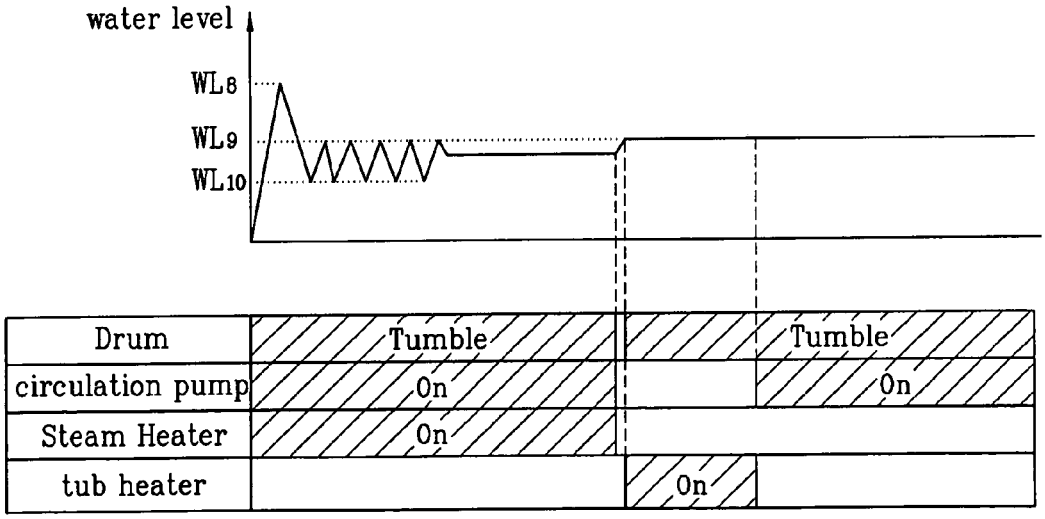
FIGS. 5 and 6 are views illustrating a third embodiment of the present invention.

FIG. 5 illustrates a third embodiment of the present invention.

In the present embodiment, the supplying of water includes an initial supplying of water and a final supplying of water. The final supplying of water is implemented at a conversion time point from a steam heater turn-on mode to a tub heater turn-on mode. During the final supplying of water, the water level in the tub rises to the predetermined water level by an additional supplying of water.

The initial supplying of water is implemented such that the water level in the tub reaches an eighth water level $WL_8$. Thereafter, an intermediate supplying of water is implemented. The intermediate supplying of water maintains the water level in the tub within a predetermined water level range. In FIG. 5, the intermediate supplying of water is implemented in such a manner that the water level in the tub is maintained between a ninth water level $WL_9$ and a tenth water level $WL_{10}$.

When the steam heater is turned off after completing the intermediate supplying of water, the final supplying of water is implemented to set the water level in the tub to the ninth water level $WL_9$. If the water level in the tub is set to the ninth water level $WL_9$, the tub heater is turned on and kept on. Likewise, if the tub temperature reaches the predetermined temperature, the tub heater is turned off.

In the initial supplying of water, the eighth water level $WL_8$ is higher than the ninth water level $WL_9$. In the present embodiment, the steam heater is turned on and kept on from the beginning time point of the initial supplying of water. Here, the steam heater can be turned on and kept on after the initial supplying of water.

In the embodiment of FIG. 5, the intermediate supplying of water is implemented to maintain the water level in the tub within the predetermined range after the initial supplying of water, and the final supplying of water is implemented after the steam heater is turned off.

Figure 6:
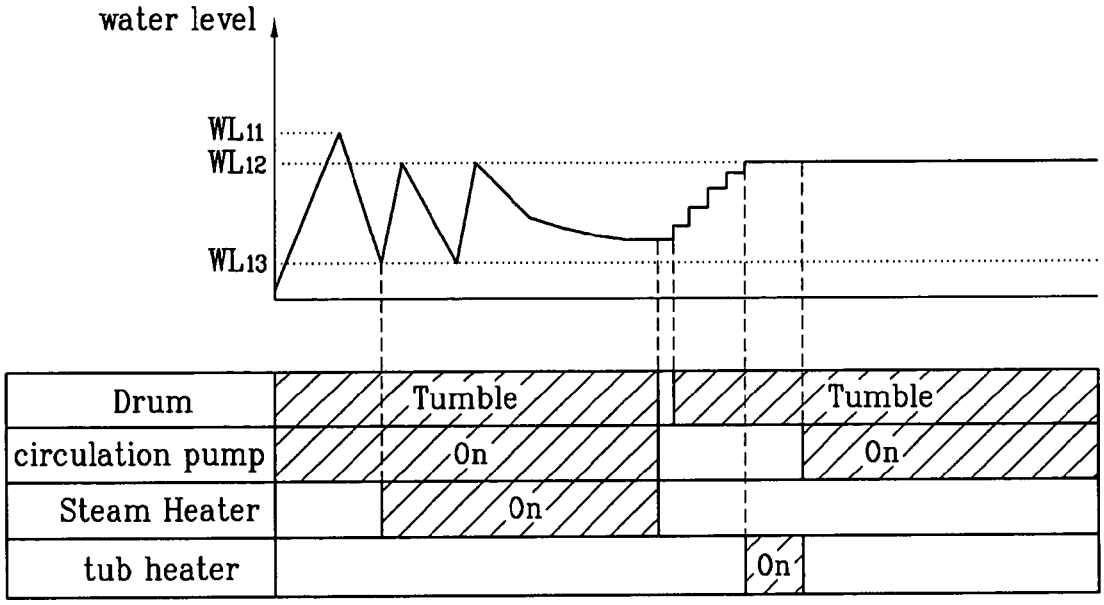

FIG. 6 illustrates another example of the above-described third embodiment.

During the initial supplying of water, the water level in the tub reaches an eleventh water level $WL_{11}$. The intermediate supplying of water is implemented to maintain the water level in the tub between a twelfth water level $WL_{12}$ and a thirteenth water level $WL_{13}$.

Here, the steam heater is turned on and kept on after the initial supplying of water.

If the steam heater is turned off, the water supply valve is opened, causing the water level in the tub to reach the twelfth water level $WL_{12}$ (in the final supplying of water). Then, the tub heater is turned on and kept on until the tub temperature reaches the predetermined temperature.

Here, the final supplying of water can be implemented as the water supply valve is controlled so as to be repeatedly turned on or off. Specifically, the water level in the tub can reach the twelfth water level $WL_{12}$ in a stepwise manner.

As apparent from the above description, the present invention provides a laundry machine to wash laundry, more particularly, a laundry machine having a steam generator to supply steam to the laundry. According to the present invention, to acquire a desired water level in the tub and a desired tub temperature, a tub heater and a steam heater can be used together, in conjunction with a controlling of a water supply valve. This is advantageous to improve energy efficiency of the laundry machine.

Further, as a result of using the tub heater together with the steam heater in consideration of an insufficient capacity of the steam generator, it is possible to acquire a desired water level in the tub and a desired temperature of wash water in the tub, which are conventionally impossible to acquire using steam alone.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A controlling method of a laundry machine having a tub, a steam generator having a steam heater, and a tub heater separate from the steam heater, the controlling method comprising:

supplying water into the tub until a water level of the tub reaches a water level predetermined for a washing step; and controlling the steam heater and the tub heater to be operated alternately until a temperature inside the tub reaches a temperature predetermined for the washing step at the predetermined water level.

2. The controlling method of claim 1, further comprising, after the temperature reaches the predetermined temperature, rotating a drum in the tub to continue the washing step.

3. The controlling method of claim 1, wherein the supplying of water ends before the controlling of the heaters starts.

4. The controlling method of claim 3, wherein the controlling of the heaters comprises keeping the heaters on alternately for respective preset periods of time.

5. The controlling method of claim 4, wherein the controlling of the heaters comprises sequentially:

keeping the tub heater on for a preset period of time;

keeping the steam heater on for a preset period of time; and keeping the tub heater on for a preset period of time.

6. The controlling method of claim 1, wherein the supplying of water comprises gradually supplying the water while the steam heater is on.

7. The controlling method of claim 6, wherein the gradual supplying ends when the water level of the tub reaches the predetermined water level.

8. The controlling method of claim 7, wherein the controlling of the heaters comprises keeping the tub heater on after the gradual supplying ends.

9. The controlling method of claim 6, wherein the supplying of water further comprises initially supplying the water to raise the water level of the tub up to or higher than the predetermined water level in one opening of a water supplying valve.

10. The controlling method of claim 9, wherein the controlling of the heaters comprises keeping the tub heater on between the initial supplying and the gradual supplying.

11. The controlling method of claim 1, wherein the supplying of water comprises:

initially supplying the water; and finally supplying the water up to the predetermined water level when or in between turning off the steam heater and turning on the tub heater.

12. The controlling method of claim 11, wherein the controlling of the heaters ends with turning off the tub heater.

13. The controlling method of claim 12, wherein the supplying of water further comprises intermediately supplying the water to keep the water level of the tub within a predetermined water level range.

14. The controlling method of claim 13, wherein the intermediate supplying of the water comprises supplying water more than twice.

15. The controlling method of claim 13, wherein the initial supplying of the water comprises supplying the water to raise the water level of the tub up to or higher than the predetermined water level in one opening of a water supplying valve.

16. The controlling method of claim 13, wherein an upper limit of the predetermined range is the same as the predetermined water level.

17. The controlling method of claim 1, wherein the controlling of the heaters ends with turning off the tub heater.

18. The controlling method of claim 1, further comprising keeping a circulation pump off while the tub heater is on.

19. A laundry machine comprising:

a tub to hold water for washing;

a water supply valve to open and close a water line toward the tub;

a tub heater mounted in the tub to heat the water;

a steam generator to generate steam by heating water with a steam heater, separate from the tub heater; and a controller to control the water supply valve, the tub heater, and the steam heater for a washing step so as to cause a temperature inside the tub to reach a predetermined temperature at a water level predetermined for the washing step, the controller controls the steam heater and the tub heater to be operated alternately.

* * * * *